US005201204A

United States Patent [19]

Hinterman et al.

[11] Patent Number: 5,201,204

[45] Date of Patent: Apr. 13, 1993

[54] PRESS COUNTERBALANCE SYSTEM

[76] Inventors: William Hinterman, G-5034 Fenton Rd., Flint, Mich. 48507; Timothy Hinterman, 2104 Cadillac St., Flint, Mich. 48504

[21] Appl. No.: 937,973

[22] Filed: Aug. 31, 1992

[51] Int. Cl.[5] ..... B21D 24/02

[52] U.S. Cl. ..... 72/19; 72/443; 72/438; 100/259

[58] Field of Search ..... 72/19, 21, 436, 438, 72/443, 445, 450; 100/259, 231

[56] References Cited

U.S. PATENT DOCUMENTS

| | | | |
|---|---|---|---|
| 3,115,086 | 12/1963 | Stimmel | 100/259 |
| 4,011,809 | 3/1977 | Waller et al. | 100/259 |
| 4,013,002 | 3/1977 | Schneider et al. | 100/259 |
| 4,069,697 | 1/1978 | Morrison et al. | 72/445 |
| 4,148,209 | 4/1979 | Bessho | 72/445 |
| 4,205,617 | 6/1980 | Chmielowiec | 72/19 |
| 4,283,924 | 8/1981 | Heiberger | 72/445 |
| 4,308,735 | 1/1982 | Nishi | 100/259 |
| 4,552,002 | 11/1985 | Haenni et al. | 72/19 |
| 4,606,205 | 8/1986 | Segredo et al. | 72/19 |
| 4,692,857 | 9/1987 | Chi | 72/21 |
| 4,907,435 | 3/1990 | Schulze | 72/21 |
| 4,918,956 | 4/1990 | Schoch | 72/21 |
| 4,969,344 | 11/1990 | Hinterman et al. | 72/19 |
| 4,993,270 | 2/1991 | Petit et al. | 72/19 |
| 5,009,091 | 4/1991 | Hinterman et al. | 72/21 |
| 5,027,631 | 7/1991 | Naito | 72/19 |

*Primary Examiner*—David Jones

*Attorney, Agent, or Firm*—Gifford, Groh, Sprinkle, Patmore and Anderson

[57] ABSTRACT

A control system for automatically counterbalancing the ram and tooling of a mechanical press by the measurement of strain in a press component or components subject to stress during operation of the press. The air pressure in one or more counterbalancing cylinders is varied to maintain balanced conditions in response to the strain measured at the top of the press cycle.

10 Claims, 1 Drawing Sheet

PRESS COUNTERBALANCE SYSTEM

BACKGROUND OF THE INVENTION

1. Field of the Invention

This invention relates to a control system for a mechanical press, and, more particularly, to an automatic control system for adjusting the counterbalance for such a press.

2. Description of the Prior Art

Mechanical presses are commonly used for stamping, bending, blanking, embossing and otherwise shaping materials, usually metals. Replaceable die sets are used to do such forming with a lower die half attached to a stationery bed or platen and an upper die half attached to a ram or slide which reciprocates vertically. Typically in a mechanical press, an electric motor is used to rotate a counter weight, bringing the rotational speed of the counter weight up to a no-load equilibrium speed which will provide the proper kinetic energy to perform the forming operation. A clutch mechanism engages the flywheel which, through gears and mechanical linkage, including at least one crank, reciprocates the ram in its working cycle using the inertia of the flywheel. Counterbalances are used to counterbalance the moving weight of the ram and its attached upper die half or punch to provide smooth operation, easier stopping, and less wear on the gears, bearings and other moving parts of the press.

Mechanical presses commonly use one or more pneumatic cylinders to perform the counterbalancing function. Typically, the air pressure is adjusted by the press operator through a manual pressure regulator when a new set of dies are put into the press to compensate for the change in the weight of the die. Usually, very little further adjustments are made of the air pressure, unless they are made pursuant to the "feel" that an experienced operator has in the efficient running of the press.

Systems have been developed for automatically adjusting the air pressure in an attempt to compensate for various effects. For example, in U.S. Pat. No. 4,283,929, the die sets, or at least the upper die or punch member is encoded so that when a new die set is put into the machine, this coding is read by the machine to automatically make an adjustment in the counterbalance air pressure to compensate for the change in the weight of the die. Other attempts have been made to automatically compensate for change in the die weight by measurement of the motor current only. U.S. Pat. No. 4,069,697 teaches changing the air pressure responsive to a current signal so that adjustments for excess counterbalancing is accomplished on a down stroke and compensation for insufficient counterbalancing is done on an upstroke. Unfortunately, adjustments for die weight or motor current only solves part of the problem.

In our U.S. Pat. No. 4,969,344 we have set forth a control system for automatically counterbalancing the ram of a mechanical press by measuring the energy level of the press flywheel and varying air pressure in one or more counterbalancing cylinders. The energy level is derived from a measurement of the rotational speed of the flywheel at a fixed point in the ram reciprocation cycle. The energy level of the flywheel in an alternative embodiment is determined by measuring the power drawn by the electric motor which in turn engages the flywheel. It should be noted that in this mode the total power must be measured and not merely the motor current which can vary with line voltage and power factor.

In our U.S. Pat. No. 5,009,091 we set forth another control system for automatically counterbalancing the ram by varying air pressure in one or more counterbalancing cylinders with the energy level of the press flywheel being determined by a measurement of the linear speed of a moving press component at a fixed point in the ram reciprocation cycle. The speed of the ram can be determined by measuring the speed of one or more of the press drive components. In a more complex embodiment of this control system, a first sensor detects the speed of the ram during an upstroke, a second sensor detects the speed of the ram during a downstroke and another sensor measures the rotational speed of the flywheel. All of these measurements are used by the control means to determine if a counterbalance condition needs to be changed by increasing or decreasing the pressure in the counterbalance air cylinders.

SUMMARY OF THE INVENTION

While the energy level-speed change measurement systems of our two above-mentioned patents function well, it is a primary purpose of the present invention to provide a more versatile means for sensing unbalance so that one or more sensing units can be located at strategic positions to meet the particular needs of any given metal working press.

The sensor of the present invention is a strain gage which can be put on any press element subject to stress and resultant strain. The strain change in length repeats itself every cycle of the press, that is every revolution of a rotating crank drive member or reciprocation cycle of the press ram and associated moving parts.

The compact size of strain gages and their ease in attachment to machine elements permits the location at strategic points. For example, where the press has multiple cranks, usually two or four, the press also normally will have at least two counterbalancing air cylinders. Location of a strain gage on each crank will allow a determination of whether the air cylinders should be commonly controlled or should be independently controlled to achieve optimum counterbalancing. Likewise, dual action presses with either an inner and outer die or presses which have two separate rams both simultaneously taking energy from one flywheel during a cycle of the press can now be dynamically balanced. The parallelism of the upper to lower die can also be adjusted through strain gage analysis and can be subsequently controlled through the use of the strain gage as the primary sensing unit.

The upper dies are sometimes mounted off center from the ram horizontal x and y planes causing an imbalance on various drive components and structural frame members, and unparallel conditions could exist between upper and lower die. Through an analysis of the strain gage data and computer software, zone control of each individual counterbalance cylinder can balance out the tonnage displacement, that is, the areas of unequal stress.

Thus the invention pertains to a press which engages a flywheel to impart energy to reciprocate a ram through interconnected drive components where the press has air-operated cylinders for automatically counterbalancing the downward working force of the ram. The improved system of the invention adjusts the counterbalancing air pressure in the air cylinders. One or more strain gages are attached to press elements subject to stress. A control system, which can be of the microprocessor type is programmed or designed to identify changes in compression and tension of the individual strain gages and to increase or decrease the air pressure in the air operated cylinders according to these changes to overcome under or over counterbalancing. Typically, the press element can be a drive train or a frame member of the press.

The improved system includes means for detecting the top portion of the press ram reciprocation cycle to enable the controller to process strain values during that top portion for example, 10° on either side or from 350° to 10°. The detector detects this top position from a rotating linkage member of the press.

Valves can be used for increasing pressure by allowing delivery from a compressed air source or for decreasing the air pressure by bleeding air from the cylinders.

The foregoing advantages and other will become more apparent from the following description and the accompanying drawing.

DETAILED DESCRIPTION OF THE PREFERRED EMBODIMENTS OF THE INVENTION

Figure 1:
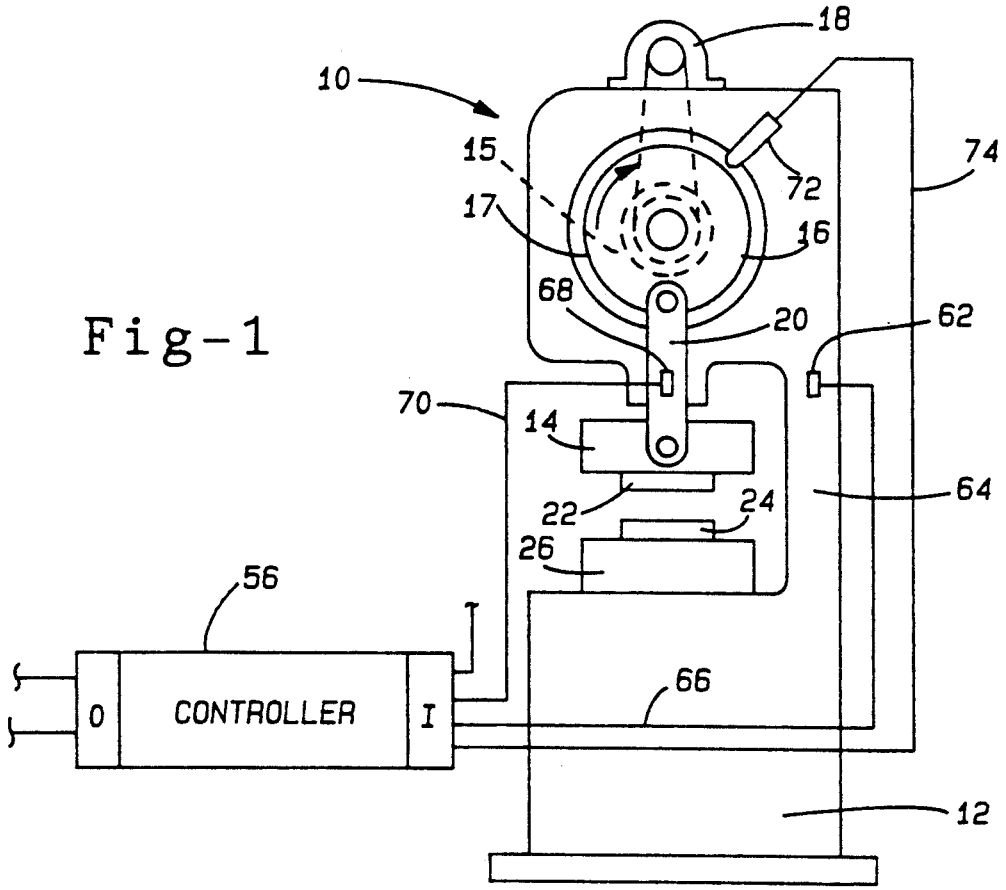
FIG. 1 is a schematic side elevation of a metal working press showing typical positioning of the strain gage sensing units and a detector detecting the top cycle position with the counterbalancing air cylinders omitted for clarity.

Referring to FIG. 1, a typical metal working press 10 is shown schematically. The frame 12 of the press carries a single ram 14 for reciprocating movement by the rotation of flywheel 16 driven by motor 18 and crank 20 which translates the rotary motion of the motor 18 and flywheel 16 into linear motion of the ram 14. Typically the flywheel is allowed to come up to equilibrium speed so that it has the energy to perform its metal working job, and then a clutch 15 engages the flywheel 16 with linkage 17 and crank 20 driving the ram. The press ram 14 carries an upper die 22 which cooperates with a lower die 24 affixed to the press frame 12 through platen 26. When the flywheel is engaged, the upper die 22 moves towards the lower die 24 to perform a metal working function between the two dies for each revolution of the rotating drive member 17. Dies 22 and 24 are replaceable for different parts being stamped or for maintenance and repair.

Figure 2:
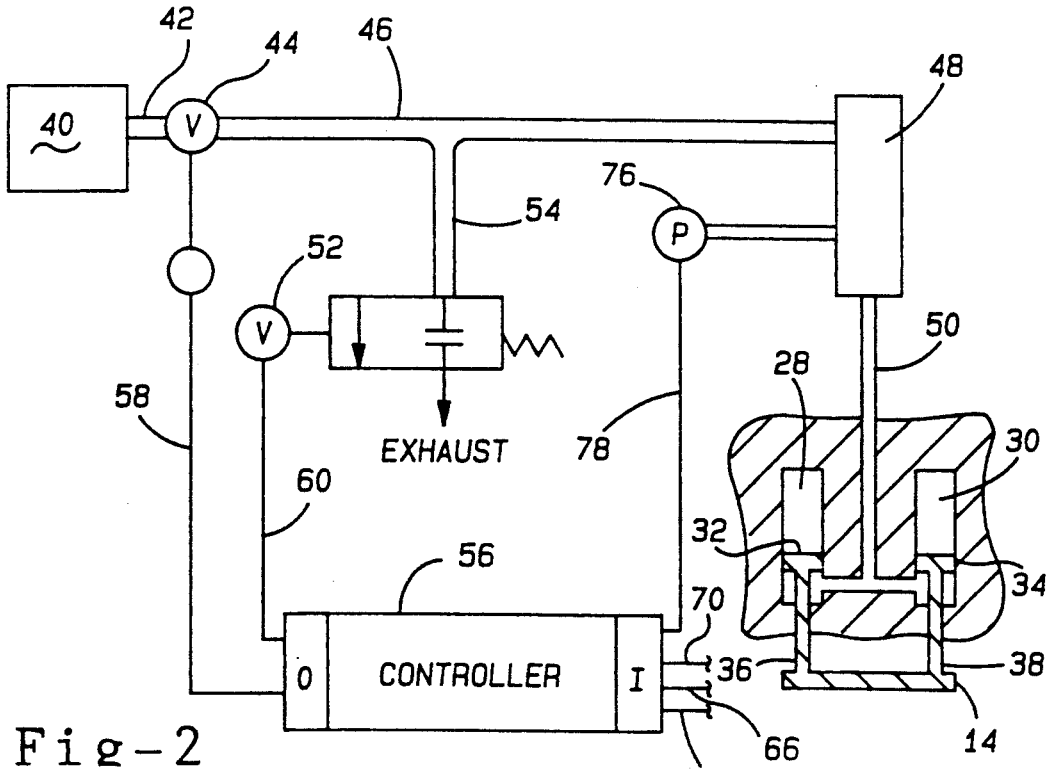
FIG. 2 is a schematic view of the control system as it is connected to the strain gage sensing lines and position detector of FIG. 1 showing the control and means for changing the air pressure in response to these signals.

Referring to FIG. 2, the downward force of the ram 14 in its working cycle is counterbalanced by compensating air cylinders 28 and 30 which are connected to the ram 14 through pistons 32 and 34 by piston rods 36 and 38. Compressed air is supplied to the cylinders 28 and 30 from a source 40 through line 42, pressure regulating valve 44, line 46, surge tank 48 and line 50. Air is exhausted from the cylinders 28 and 30 by solenoid operated exhaust valve 52 through air line 50 to surge tank 48, and air lines 46 and 54. It will be appreciated that two cylinders 28 and 30 have been shown, but typically there may be one or more air cylinders, for example, there may be an air cylinder at all four corners of the ram 14. Likewise, FIG. 2 shows a common air supply through line 50 to both cylinders 28 and 30 for simplicity; however, these air cylinders can be individually controlled where required. Also other equivalent valve arrangements can be utilized with one or more counterbalancing air cylinders.

Referring to FIG. 1, the strain gages can be placed on any portion of the press which is subject to stress and consequent strain. Strain gage 62 is located on the vertical portion 64 of press frame 12 and transmits a signal through line 66 to controller 56. Strain gage 68 is located on crank 20 and transmits a signal to controller 56 through line 70. One or both of these sensors 62 and 68 can be used in the final control of the press 10. If the press 10 had four cranks, a strain gage may be located on each of the cranks and used in the final control process.

The controller 56 receives sensor signals at I and outputs control signals to the valve system at O. Namely, when the control 56 indicates a change in counterbalancing air pressure is necessary, the controller outputs a control signal through line 58 to pressure regulator valve 44 to increase or decrease the pressure in the counterbalancing cylinders 28 and 30. When a decrease in counterbalancing air pressure is necessary, the controller 56 also outputs a signal through line 60 to solenoid valve 52 to decrease pressure in counterbalancing cylinders 28 and 30 by exhausting air to atmosphere.

Detector 72 detects the instantaneous position of the rotating linkage 17 which in turn correlates to the linear position of the ram 14. For reasons which will be explained, the top portion of the ram reciprocation cycle is detected, preferably from about 350° through 10° and the detector 72 transmits an enabling signal through line 74 to the controller 56 for that portion of the working cycle. This enables the controller 56 for processing the strain values sensed by sensors 62 and 68 during this top portion of the press cycle.

Another input which can be made to controller 56 is shown in FIG. 2 in the form of a measurement of pressure in the counterbalancing cylinders 28 and 30 through pressure transducer 76 connected to surge tank 48 which allows a feed back control in that it indicates when the counterbalance pressure settles to a new value. This signal is transmitted to the controller through line 78.

OPERATION

The air pressure on counterbalance cylinders 28, 30 imparts a force on the press's drive components and frame which incudes a mechanical stress on these members. It is recognized that the stress created by the same counterbalance pressure condition on different applications may be either tension or compression due to the design of the press and/or the placement of the sensor. For the purpose of this analysis it is assumed that an "over balanced" condition creates a compressed stress. This stress induces a strain on sensor 62 which creates an electrical signal indicative to this strain. This signal reflects the degree of compression or tension in the frame 64, resulting from the counterbalance air pressure levels in cylinders 28 and 30. Sensor 62 with zero stress applied will emit a base electrical signal. If a compressed stress is applied to sensor 62, the signal indicating the resultant strain will propagate from the base voltage in an increasing or decreasing direction. Likewise, a tensile stress applied to sensor 62 will create a signal indicating the resultant strain which will propagate from the base voltage in the opposite sense as that of the compressed condition.

If the opposing force created by said pressurized cylinders is greater than the weight frame 14, tooling 22 and portions of the drive train linkages, the resulting condition is referred to as a state of "over balance". The most desirable condition being a slightly over balanced condition. An over balanced condition is indicated by a compressed stress in frame 64 and sensor 62. When the opposing force created by air pressurized cylinders 28, 30 is less than the weight of ram 14, tooling 22 and associated drive train components, the resulting condition is referred to as an "under balanced" condition. An under balanced condition is indicated by a tensile stress in frame 64 and sensor 62.

Two reference signals are generated in the controller using trimming potentiometers, not shown, but part of controller 56. The first trimmer established the minimum allowable strain of sensor 62. The second trimmer established the maximum allowable strain of sensor 62. It is these two values which are compared to the actual signal generated by sensor 62, which allow the counterbalance pressure to be dynamically controlled.

"Top position" location is indicated using detector 72. The area of indication is established from 350° through −10° of the press cycle. At this position, the degree of counterbalance pressure has the least amount of stress influence on the frame 64 and sensor 62. This area of least amount of stress is the primary concern. As long as the strain signal reflects a compressed value, an over balanced condition exists throughout the entire stroke cycle of the press. The minimum/maximum trimmers establish the degree of over balancing pressure. Position indicator 72 can be an adjustable contact closure, encoder, resolver or any similar device.

Another embodiment of this new system concerns the attachment of sensor 68 to any element of the drive mechanism of the press. "Any element" refers to any component of the drive mechanism existing between clutch 16 and tooling 22. Some elements can be identified as clutch 16, crank 20 or linkage 15.

Evaluation of the electrical signal generated by sensors 62 and 68 is enabled when the press's stroke cycle is within the Top Position range detected by detector 72 indicator. The controller samples the signal generated by the sensors and compares it to the minimum and maximum reference values established by the associated trimming potentiometers. If the strain value is less than the minimum reference value, the counterbalance pressure will be increased by adjusting the output signal of controller 56 to valve 44. If the strain value is greater than the maximum reference value, the counterbalance pressure will be decreased by adjusting the output signal of controller 56 to valve 44. Exhaust valve 52 is also activated by controller 56 to relieve the excess pressure contained within cylinders 28, 30 and the rest of the counterbalance system.

The degree of overbalance is determined by the minimum/maximum trimming potentiometers attached to or a part of controller 56. The trimmer setting procedure is as follows:

Move the press position to its Top Position.

Increase the maximum trimmer setting to its greatest value.

Lower the minimum trimmer setting to achieve a tensile stress or underbalanced indication.

Slowly raise the minimum trimmer setting until a slightly compressed stress is indicated.

Decrease the maximum trimmer to achieve a slightly greater value than the minimum trimmer setting.

Strain gauges have been used on metal working presses to monitor load and, for example, to initiate a warning overload signal or to shut the press down upon overload, but prior to this invention no suggestion has been made to use strain as a primary control element in an automatic counterbalance control system.

It will be apparent with the new technology of applying strain gages to the press for primary control, that under or over balanced conditions are responded to much more quickly than in prior art control systems. It will also be apparent, that the specific methodology used in calibrating the press by the use of potentiometers can be varied while providing sufficient data for smooth and rapid counterbalance adjustment.

We claim:

1. In a press which engages a flywheel to impart energy to reciprocate a ram through interconnected drive components, said press having air-operated cylinder means for automatically counterbalancing the downward working force of said ram, an improved system for adjusting the counterbalancing air pressure in said air cylinder means comprising:

sensor means for sensing strain in a press element which is indicative of the stress imparted to said element;

a control system which detects a change in the strain sensed by said sensor means and increases or decreases the air pressure in said air-operated cylinder means according to said detected change to overcome under or over counterbalancing.

2. The improved system according to claim 1 wherein said press element is a crank connected to said ram.

3. The improved system according to claim 1 wherein said press element is a frame member of said press.

4. The improved system according to claim 1 wherein said sensor means includes a plurality of sensors located on different press elements and said control system detects the changes in strains sensed by said sensors and increases or decreases air pressure in said air-operated cylinder means.

5. The improved system according to claim 4 wherein said air-operated cylinder means includes a plurality of air cylinders.

6. The improved system according to claim 1 further including detector means for detecting a top portion of a reciprocation cycle of said ram enabling said control system to detect changes in strain value sensed by said sensor for the top portion of said reciprocation cycle.

7. The improved system according to claim 6 wherein said top portion is between approximately 350° and 10° of a rotating member of said press.

8. In a press which engages a flywheel to impart energy to reciprocate a ram through interconnected drive components, said press having air-operated cylinder means for automatically counterbalancing the downward working force of said ram, an improved system for adjusting the counterbalancing air pressure in said air cylinder means comprising:

sensor means for sensing strain in a press element which is indicative of the stress imparted to said element;

detector means for detecting a top portion of a reciprocation cycle of said ram and issuing an enabling signal;

valve means for increasing or decreasing the air pressure in said cylinder; and a control system which detects a change in the strain sensed by said sensor means during the top portion of said reciprocation cycle when enabled by said enabling signal, and to actuate said valve means to increase or decrease the air pressure in said air-operated cylinder means according to said change in strain to overcome under or over counterbalancing.

9. The improved system according to claim 8 wherein said sensor means includes a plurality of sensors located on different press elements, and said control means detects changes in the strain sensed by said sensors during the top portion of said reciprocation cycle detected by said detector means.

10. The improved system according to claim 9 wherein said air-operated cylinder means includes a plurality of air cylinders.

* * * * *